United States Patent [19]

Bates, III et al.

[11] 4,235,331

[45] Nov. 25, 1980

[54] COLLAPSIBLE BASKET

[76] Inventors: Claude F. Bates, III; Duane R. Olson, both of 17801 SW. 112 Pl., Miami, Fla. 33157

[21] Appl. No.: 39,514

[22] Filed: May 16, 1979

[51] Int. Cl.[3] ..... B65D 6/16; B65D 71/00

[52] U.S. Cl. ..... 206/170; 206/198; 206/203; 220/6; 220/94 R; 224/48 D; 224/45 R

[58] Field of Search ..... 220/6, 94 R; 206/178, 206/198, 203; 224/45 H, 45 P, 55, 48 D

[56] References Cited

U.S. PATENT DOCUMENTS

| | | | |
|---|---|---|---|
| 1,244,600 | 10/1917 | Hadgieff | 220/94 R |
| 2,531,092 | 11/1950 | Waller | 206/170 |
| 2,844,279 | 7/1958 | Kovach | 206/170 |
| 3,039,651 | 6/1962 | Lang | 206/203 |
| 3,115,266 | 12/1963 | Poupitch | 206/203 |
| 3,254,786 | 6/1966 | Melville | 220/6 |
| 4,147,286 | 4/1979 | Bates | 224/45 R |

FOREIGN PATENT DOCUMENTS

| | | | |
|---|---|---|---|
| 481795 | 3/1952 | Canada | 224/48 D |

*Primary Examiner*—George E. Lowrance
*Attorney, Agent, or Firm*—Ernest H. Schmidt

[57] ABSTRACT

A collapsible basket for carrying side-by-side grocery bags or the like has a rectangular shaped, vertically-extending framework between the lower ends of which are pivotally secured inner end portions of a pair of opposed rectangular bottom panels the outer ends of which have pivotally secured thereto lower end portions of opposed side panels. The upper end corners of the side panels are linked to each other and to central portions along the length of the handle member at each side to provide substantially parallel guide mechanism operation of the side panels with respect to the axial plane of the handle, thereby to permit compact collapsing of the bottom and side panels against each side of the handle member. The lower end of the frame member is provided, centrally along its length, with an inwardly-collapsible handle for use in carrying the container in inverted position when collapsed.

3 Claims, 6 Drawing Figures

COLLAPSIBLE BASKET

This invention relates to basket-like containers or carriers for carrying from place to place one or more articles that would otherwise be difficult to carry, and is directed particularly to such carriers or baskets that are compactly collapsible or foldable for convenience in carrying and storage when not being used for carrying articles.

In grocery shopping, for example, the groceries are usually packed in large paper bags that often quite heavy and difficult and awkward to carry. When there are two or more packed bags to carry it is customary to use a shopping cart for carrying them to the parking area where they can be individually loaded for transportation. In many supermarkets, however, use of shopping carts outside of the store is not permitted unless under the control of the "bag boy" or other store employee. Also when this service is not available, the shopper must provide for his or her own means for carrying out of the grocery bags. It is, accordingly, the principal object of this invention to provide a hand carrier for grocery bags and the like which can be used for carrying one or two heavy grocery bags with ease and with firm support at the sides of the bag to minimize any possibility of a bag breaking or tearing.

It is another object of the invention to provide a hand carrier for grocery bags and other objects of like size, such as six-peck canned or bottled beverages, that can be compactly collapsed or folded when not in use to facilitate empty carrying and storage.

Another object of the invention is to provide a collapsible hand carrier of the above nature which, when fully collapsed, can easily be carried in pairs with the use of one hand for use in carrying three or more grocery bags, one filled carrier in each hand, in a single trip.

Another object is to provide a collapsible hand carrier or basket of the above nature that can readily be fabricated of synthetic plastic materials, and which will be inexpensive to manufacture, light in weight, and durable in use.

Other objects, features and advantages of the invention will be apparent from the following description when read with reference to the accompanying drawings. In the drawings, wherein like reference numerals denote corresponding parts throughout the several views.

Figure 1:
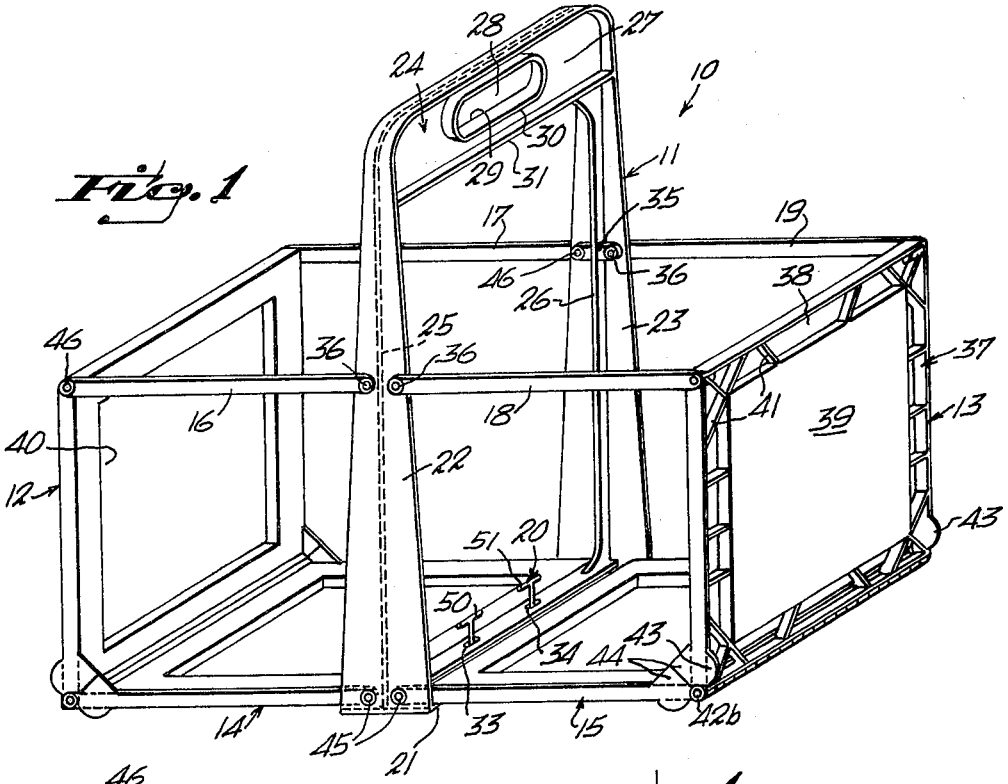
FIG. 1 is an oblique view of a preferred form of collapsible basket embodying the invention, as viewed from above.

Referring now in detail to the drawings, reference numeral 10 designates a foldable basket embodying the invention, the same preferably being fabricated, for the most part, of molded synthetic plastic parts. The basket

10 comprises a generally rectangular frame member 11, a pair of rectangular side panels 12, 13, a pair of rectangular bottom panels 14, 15, all of which side and bottom panels are of identical structure as is hereinafter described, four identical link members 16, 17, 18, and 19 and an auxiliary handle member 20 (see FIG. 6).

The frame member 10 is integrally molded to have a flat bottom wall portion 21 the ends of which merge with upwardly-extending, parallel, substantially flat side-wall portions 22, 23 which are tapered to decreased width at their upper ends and which upper ends are interjoined by a transversely-extending basket handle portion 24. Central, inwardly-directed ribs 25, 26 are formed along the insides of the frame side wall portions 22, 23, respectively, for strengthening purposes. The basket handle portion 24 is similarly formed with a transversely-extending, central rib portion 27, said rib portion being provided with an elongated central opening 28 for carrying purposes. The central opening 28 is formed at each side with outwardly-projecting flange portions 29, 30. The lower edge of basket handle rib portion 27 merges with a transverse horizontal rib 31 extending between frame side wall portions 22, 23.

The flat bottom wall portion 21 of frame member 11 is also provided with stiffening means in the form of an inside, central, end-to-end rib 32 which is generally of T-shaped cross-sectional configuration. The rib 32 is provided along its length with a pair of symmetrically-spaced, longitudinally-extending, elongated openings 33, 34, which openings extend through flat bottom wall portion 21 of said frame member, for the purpose hereinafter appearing.

The side wall portions 22, 23 of the frame member 11 are also integrally formed, in spaced relation from their upper ends, with opposed, laterally-extending, elongated boss portions 35 (only one illustrated in FIG. 1), which boss portions are bisected by inwardly-directed ribs 25, 26, respectively. End portions of the bosses 35 are formed with perpendicularly-extending through openings for the reception of link pivot pins or eyelets 36, as is hereinafter more particularly described.

As described above, the side panels 12, 13, 14, 15 are of identical structure and integrally molded. Therefore, only side panel 13 will be described herein in detail by way of example. With reference to FIG. 1, 3, 4, and 5, it will be seen that the side panel 13 is formed with a rectangular, peripheral rim portion 37 comprising a channel 38 of U-shaped cross-section, the inner terminal edges of which channel merge with a flat panel portion 39, thereby defining a rectangular panel recess 40 at the inside (see side panel 12 in FIG. 1). The peripheral recess defined by channel 38 is integrally molded with interior cross ribs 41 for strengthening purposes. One outer edge of each side panel, the lower edge of side panel 13, for example, is integrally formed along its length with a plurality of uniformly-spaced, outwardly-projecting lugs 42. The side-to-side width of the lugs 42, and their mutual spacing are substantially identical to permit the interengagement or intermeshing of the lugs of one panel with the lugs of another panel. Thus, in assembly of the basket, the lugs **42*a* of bottom panel 15 intermesh with lugs 42 of side panel 13. All of the panel lugs 42 (and 42*a*) are transversely drilled in central, coaxial alignment to permit pivotal interconnection of side panels 12, 13 with their associated bottom panels 14, 15, respectively, by means of pivot rods 42*b*. It is to be noted that the series or plurality of lugs 42** of each panel is off-set to one side by the distance of the width of one of the lugs, so that when side and bottom panel pairs are intermeshed and pivotally assembled as described above, their lateral edges will lie in common planes.

Figure 2:
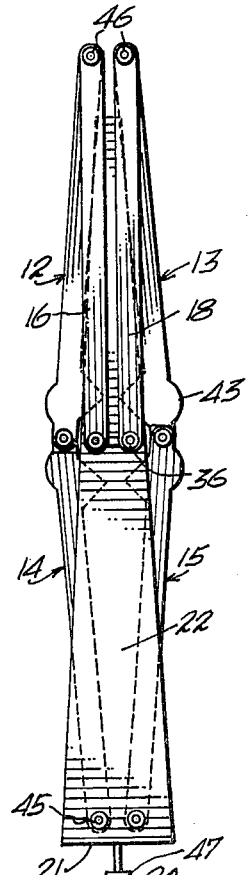
FIG. 2 is a side elevational view, showing the basket in fully folded or collapsed condition.
Figure 3:
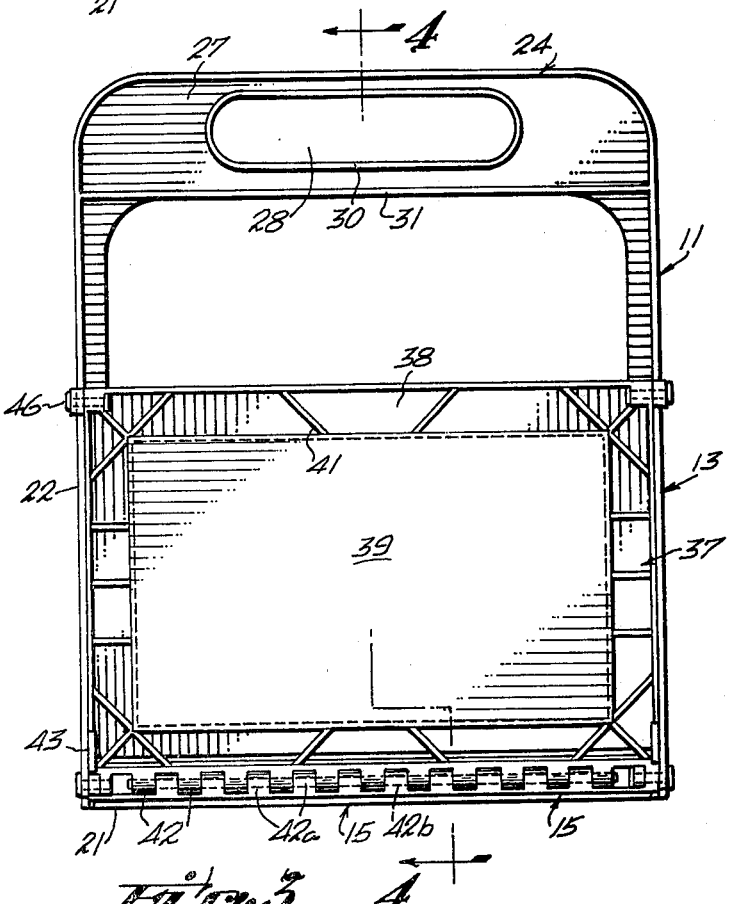
FIG. 3 is an elevational view of the open basket as seen from one end.

As best illustrated in FIGS. 1 and 2, opposed outer side wall portions of side panel channel 38, at the lower ends thereof as illustrated in FIG. 1, are formed at the outside with arcuately projecting foot portions 43 and inwardly-projection isocles triangle portions 44, for the purpose hereinafter appearing.

In assembly of the basket, brass eyelet pins 45 extend through laterally-spaced openings at the lower ends of side wall portions 22, 23 of frame member 11, and through openings at the ends of the inner channel portions 38 of the bottom panels 14, 15, whereby said bottom panels can be pivoted upwardly with respect to the frame member 11 as illustrated in FIG. 2 and as is hereinafter more particularly described. As best illustrated in FIG. 1, link members 16, 17, 18 and 19 pivotally interjoin upper end portions of the rectangular side panels 12, 13 with the above-described openings in elongated boss portions 35 of the frame member 11 by means of eyelet pins 46 and 36.

Figure 4:
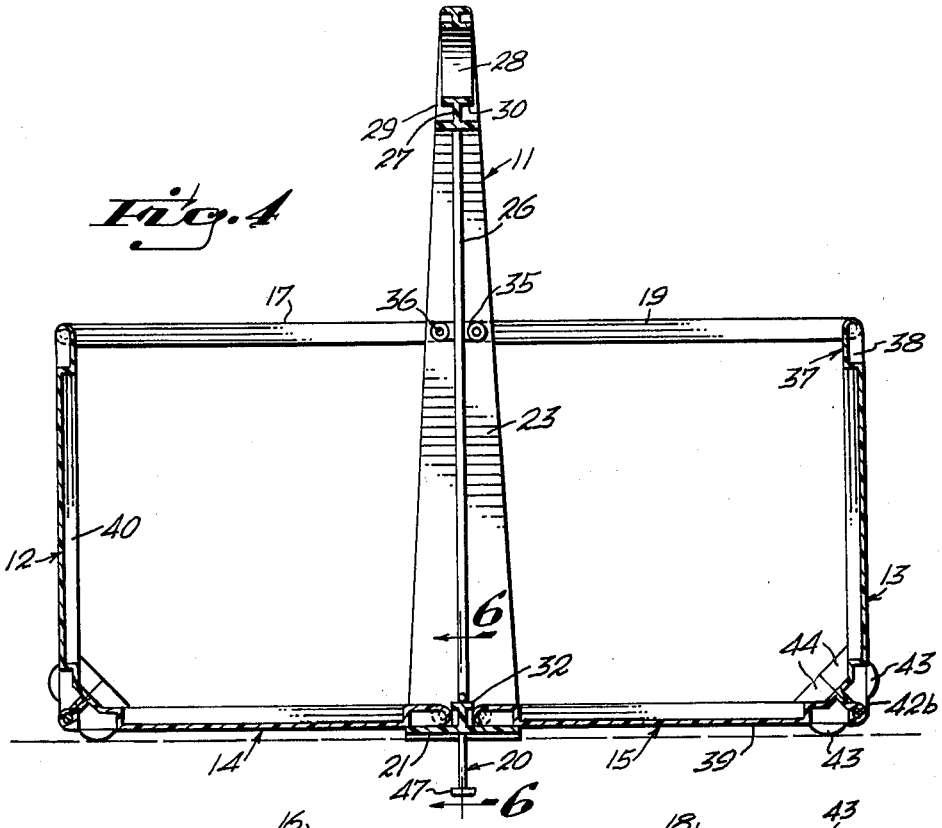
FIG. 4 is a vertical cross-sectional view of the basket, taken along the line 4—4 of FIG. 3 in the direction of the arrows.
Figure 5:
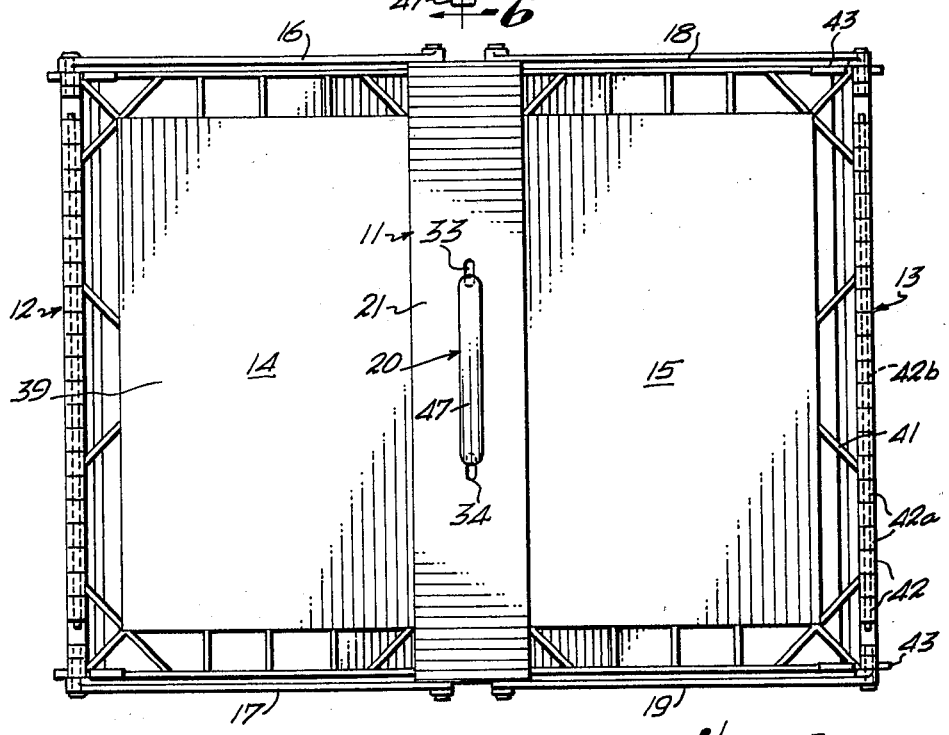
FIG. 5 is a bottom plan view of the open basket.

As illustrated in FIGS. 1 and 4, the lengths of the link members 16, 17, 18, 19 and their points of pivotal connection with frame member 11, are such as to define a rectangle with the above-described pivotal points of connection of the respective bottom panels 14, 15 so that, as illustrated in FIG. 2, said side and bottom panels can be collapsed flat against frame member 11. This collapsing will occur automatically when the basket assembly is inverted for carrying by the auxiliary bottom handle member 20, as is hereinafter described. When in its extended position of use, however, it is to be noted that the mutually adjacent edges of the isoscles triangle portion of the adjacent panel side and bottom pairs 12, 14 and 13, 15 respectively, will be in direct edge to edge abutment, thereby preventing the bottom panels from falling below the horizontal position of use, as illustrated in FIG. 1. In this connection it is to also be noted that, when in the extended position of use, inner edge portions of the peripheral bottom wall channels 38 will be in abutment against inner surface portions of the flat bottom wall portions 21 of the frame 11, further constraining against opening rotation of said bottom panels beyond their horizontal positions.

Figure 6:
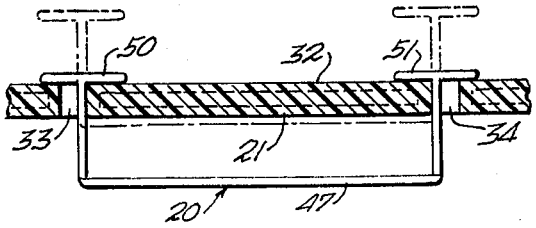
FIG. 6 is a partial vertical cross-section taken along the line 6—6 of FIG. 4 in the direction of the arrows and illustrating details of the auxiliary handle for carrying the basket when in collapsed condition.

As illustrated in FIGS. 1, 2 and 6, the auxiliary handle member 20 is integrally molded with a flat bar-like hand grip portion 47, perpendicularly extending from the ends of which are T-shaped bar portions 50, 51 which can be twisted and bent to be received through the longitudinally extending openings 33, 34 in the frame member 11, after which they resume their original shape for loose retention in place.

While there is illustrated and described herein only one form in which our invention can conveniently be embodied in practice, it is to be understood that this embodiment is presented by way of example only and not in a limiting sense. Our invention, in brief, comprises all the embodiments and modifications coming within the scope and the spirit of the following claims.

What we claim as new and desire to secure by Letters Patent is:

1. A collapsible basket comprising, in combination, a rectangular, vertically-extending frame member, said frame member having a side-to-side, substantially flat bottom wall portion, the ends of said bottom wall portion merging with vertically-upwardly-extending, parallel, substantially flat, side wall portions, the upper ends of said side wall portions being transversely interjoined by a transversely-extending basket handle portion, a pair of rectangular bottom panel members, means pivotally journaling marginal inner edge portions of said bottom panel members with respect to opposed lower end portions of said frame member side wall portions, a pair of rectangular side panel members, means pivotally securing said side panel members along the lower edge each with respect to outer marginal edge portions of said bottom panel members, and parallel guide mechanism interconnecting said side wall portions of said frame member with opposed upper edge portions, respectively, of said side panel members to permit the upward folding of said bottom panel members and said side panel members against opposite sides of said frame member, said parallel guide mechanism comprising elongated link members pivotally interconnecting said side wall portions of said frame member with said upper edge portions of said side panel members, said means pivotally securing said side panel members with respect to said bottom panel members comprising abutment mechanism preventing pivotal movement beyond right-angular disposition therebetween when said side panel members are moved downwardly and outwardly with respect to said frame member into their extended positions of use, and handle means extensible outwardly of the other side of said bottom wall portion of said frame member for carrying said basket when in collapsed and inverted condition, said side panel members and said bottom members all being of identical construction, said abutment mechanism comprising outwardly-projecting portions integrally formed with said side and bottom panel members and having abutting edge portions defined by pivotal radii subtending an angle of 45 degrees with reference to the planes of their respective panels, marginal inner edge portions of said bottom panel members being operative to rest against upper surface portions of said flat bottom wall portion of said frame member when said basket is in its extended position of use, said frame member, said bottom panel members and said side panel members each being integrally formed of a synthetic plastic material.

2. A collapsible basket as defined in claim 1 wherein said basket handle portion comprises a transversely-extending rib portion having a central, elongated hand grip opening.

3. A collapsible basket as defined in claim 2 wherein said means pivotally securing said panel members with respect to said bottom panel members comprises a plurality of outwardly-projecting, transversely-drilled lugs journalled along a common pivot rod.

* * * * *